US006334677B1

(12) United States Patent
Wen et al.

(10) Patent No.: US 6,334,677 B1
(45) Date of Patent: Jan. 1, 2002

(54) FORMAT FLEXIBLE INK JET PRINTING HAVING EFFICIENT RECEIVER USAGE

(75) Inventors: Xin Wen; Henry G. Wirth, both of Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/210,182

(22) Filed: Dec. 11, 1998

(51) Int. Cl.[7] ..... B41J 2/01
(52) U.S. Cl. ..... 347/101; 400/582
(58) Field of Search ..... 347/103, 101, 347/105, 106, 104; 346/134; 400/582, 627, 583, 596, 599, 605, 607

(56) References Cited

U.S. PATENT DOCUMENTS

| | | | | |
|---|---|---|---|---|
| 3,946,398 A | | 3/1976 | Kyser et al. | |
| 4,275,968 A | * | 6/1981 | Irwin | 400/582 |
| 4,490,728 A | | 12/1984 | Vaught et al. | |
| 4,723,129 A | | 2/1988 | Endo et al. | |
| 5,105,210 A | * | 4/1992 | Hirano et al. | 346/145 |
| 5,229,791 A | * | 7/1993 | Kuboki | 346/134 |
| 5,966,145 A | * | 10/1999 | Miura et al. | 347/9 |
| 5,971,519 A | * | 10/1999 | Horikoshi | 347/16 |

FOREIGN PATENT DOCUMENTS

| | | |
|---|---|---|
| EP | 827 833 A2 | 7/1997 |
| WO | 98/08687 | 8/1997 |

* cited by examiner

*Primary Examiner*—John S. Hilten
*Assistant Examiner*—Darius N. Cone
(74) *Attorney, Agent, or Firm*—Raymond L. Owens

(57) ABSTRACT

Ink jet printing apparatus for forming a plurality of ink images on receivers in response to one or more digital image file(s) each including at least one or more digital images and information indicating the number of ink images to be made. The ink jet printing apparatus includes at least one ink jet print head adapted to deliver ink to the receiver and at least two receiver webs. The ink jet printing apparatus selectively moves one or more receiver webs along a receiver path past the ink jet print head. A control circuitry responsive to the digital image file(s) determines the locations of the ink images to be formed on the two receiver webs in such a manner that minimizes receiver waste. The ink jet printing apparatus actuates the ink jet print head(s) to form ink images on the receiver webs, whereby receiver waste is minimized.

4 Claims, 11 Drawing Sheets

FORMAT FLEXIBLE INK JET PRINTING HAVING EFFICIENT RECEIVER USAGE

Reference is made to commonly assigned U.S. patent application Ser. No. 09/182,711, filed Oct. 29, 1998 to Wen et al., entitled "Format Flexible Ink Jet Printing"; U.S. patent application Ser. No. 09/182,351, filed Oct. 29, 1998 to Wen et al., entitled "Large and Small Format Ink Jet Printing Apparatus", and concurrently filed U.S. patent application Ser. No. 09/209,359 to Wen et al., entitled "Ink Jet Printing Having Format Flexibility and Reduced Receiver Waste". The disclosures of these related applications are incorporated herein by reference.

FIELD OF THE INVENTION

The present invention relates to an ink jet printing apparatus that can provide ink images in different format sizes on receivers in a fashion in which the receiver waste is minimized.

BACKGROUND OF THE INVENTION

Ink jet printing has become a prominent contender in the digital output arena because of its non-impact, low-noise characteristics, and its compatibility with plain paper. Ink jet printing avoids the complications of toner transfers and fixing as in electrophotography, and the pressure contact at the printing interface as in thermal resistive printing. Ink jet printing mechanisms include continuous ink jet or drop-on-demand ink jet. U.S. Pat. No. 3,946,398, which issued to Kyser et al. in 1970, discloses a drop-on-demand ink jet printer which applies a high voltage to a piezoelectric crystal, causing the crystal to bend, applying pressure on an ink reservoir and jetting drops on demand. Piezoelectric ink jet printers can also utilize piezoelectric crystals in push mode, shear mode, and squeeze mode. EP 827 833 A2 and WO 98/08687 disclose a piezoelectric ink jet print head apparatus with reduced crosstalk between channels, improved ink protection, and capability of ejecting variable ink drop size.

U.S. Pat. No. 4,723,129, issued to Endo et al, discloses an electrothermal drop-on-demand ink jet printer which applies a power pulse to an electrothermal heater which is in thermal contact with water based ink in a nozzle. A small quantity of ink rapidly evaporates, forming a bubble which causes an ink drop to be ejected from small apertures along the edge of the heater substrate. This technology is known as Bubblejet™ (trademark of Canon K.K. of Japan).

U.S. Pat. No. 4,490,728, which issued to Vaught et al. in 1982, discloses an electrothermal drop ejection system which also operates by bubble formation to eject drops in a direction normal to the plane of the heater substrate. As used herein, the term "thermal ink jet" is used to refer to both this system and system commonly known as Bubblejet™.

One advantage of ink jet printing is its capability in printing large-format images. A relatively narrow print head can print a large image on a receiver by scanning across the large printing area in multiple passes. The currently commercial large-format ink jet printers can provide ink images in the widths of 36" to 62". In contrast, a thermal resistive printer utilizes a page-wide print head. The colorants are transferred from a donor web to a receiver at the pressure contact interface between the page-wide print head and the receiver. The manufacturing difficulties and cost make it unfeasible for thermal resistive print head to be wider than a double-page size.

The advancement of ink jet printing technologies has also opened up opportunities in photographic printing for applications in photo minilabs and photo microlabs. In these environments, the ink jet printing techniques have the advantages of easy image manipulation, compatibility with digital image files, and faster turn-around time. When configured properly, ink jet printers can deliver images with qualities comparable to that of the traditional photographs. The typical photographic formats include 3R (3.5"×5"), 4R (4"×6"), page size (8.5"×11") etc. For a given width (e.g. 3.5", 4", 5"), the image length can also vary (e.g. from 5" to 12") from Classic, to HDTV and Panoramic format.

In commercial ink jet printing, it is very desirable to have one ink jet printer to print ink images in both large formats (3'×4') and traditional photographic formats. The service provider can then provide traditional photographs with added digital features and flexibility as well as poster-sizes ink images for displays for home, offices, signage, and graphic art applications.

SUMMARY OF THE INVENTION

An object of the present invention is to provide an ink jet printing apparatus for make ink images in variable and flexible formats while at the same time minimizing the waste of receiver material. In the field of photographic printing, the receiver waste is referred to as paper slugs. The receiver waste is undesirable because it increases the cost of receiver per unit area. Moreover, removing receiver waste increases the operation time and decreases throughput.

A further object of the present invention is to provide an ink jet printing apparatus that can effectively provide prints with ink images in traditional photographic formats as well as large formats.

Another object of the present invention is to provide an ink jet printing apparatus that can effectively provide ink images in small and large formats in a fashion that maximizes receiver usage.

These objects are achieved by ink jet printing apparatus for forming a plurality of ink images on receivers in response to one or more digital image file(s) each including at least one or more digital image(s) and information indicating the number of ink images to be made, comprising:

a) at least one ink jet print head adapted to deliver ink to the receiver;

b) means for providing at least two receiver webs;

c) moving means for selectively moving one or more receiver webs along a receiver path past the ink jet print head;

d) control means responsive to the digital image file(s) for determining the locations of the ink images to be formed on the two receiver webs in such a manner that minimizes receiver waste; and e) means coupled to the control means for actuating the ink jet print head to form ink images on the receiver webs, whereby receiver waste is minimized.

ADVANTAGES

An advantage of the present invention is that multiple ink image sizes can be provided by one ink jet printing apparatus. The printed ink images can be cut to the desired dimensions by two receiver cutters. The format of the prints with ink images can include the traditional photographic sizes and large format sizes.

Another advantage of the present invention is that the ink images can be printed on a plurality of ink receivers of different widths to facilitate maximum receiver usage thereby minimizing the waste of receiver material. The receivers of different widths can be simultaneously or separately transported by a receiver transport mechanism to respective printing positions.

A further advantage of the present invention is that the printing throughput is increased by printing a plurality of ink images in long printing passes. Furthermore, ink images of different formats can be printed without changing the receiver supplies and thereby also reducing operation time.

Yet another advantage of the present invention is that a time delay is provided after the printing of ink images and before the printed receivers are cut to proper sizes and stacked in a print tray, thereby permitting proper drying of the ink images.

DETAILED DESCRIPTION OF THE INVENTION

The present invention is described with relation to an ink jet printing apparatus that can provide ink images in different size formats on receivers.

Figure 1:
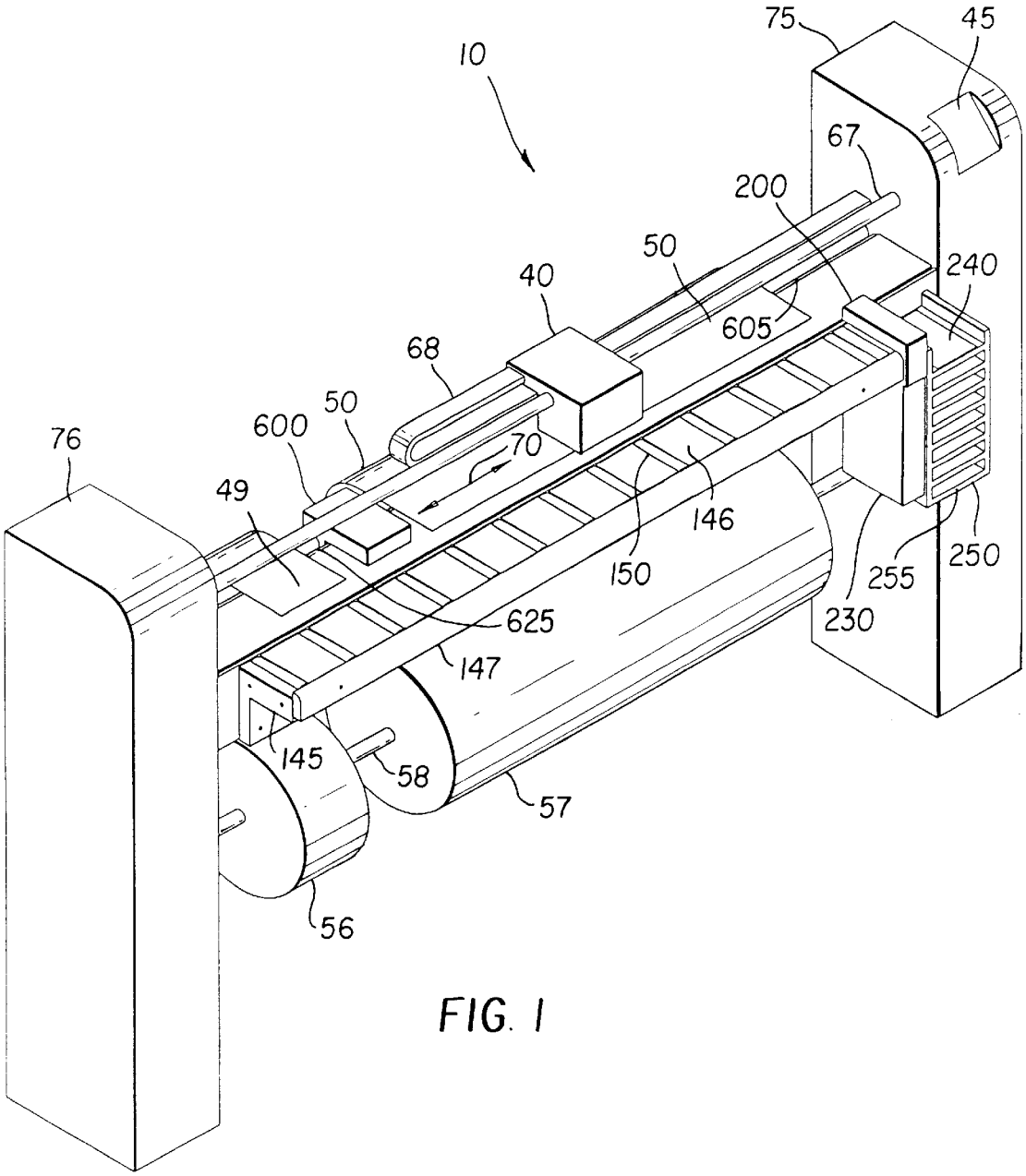
FIG. 1 is a partial perspective of an ink jet printing apparatus in accordance with the present invention.
Figure 2:
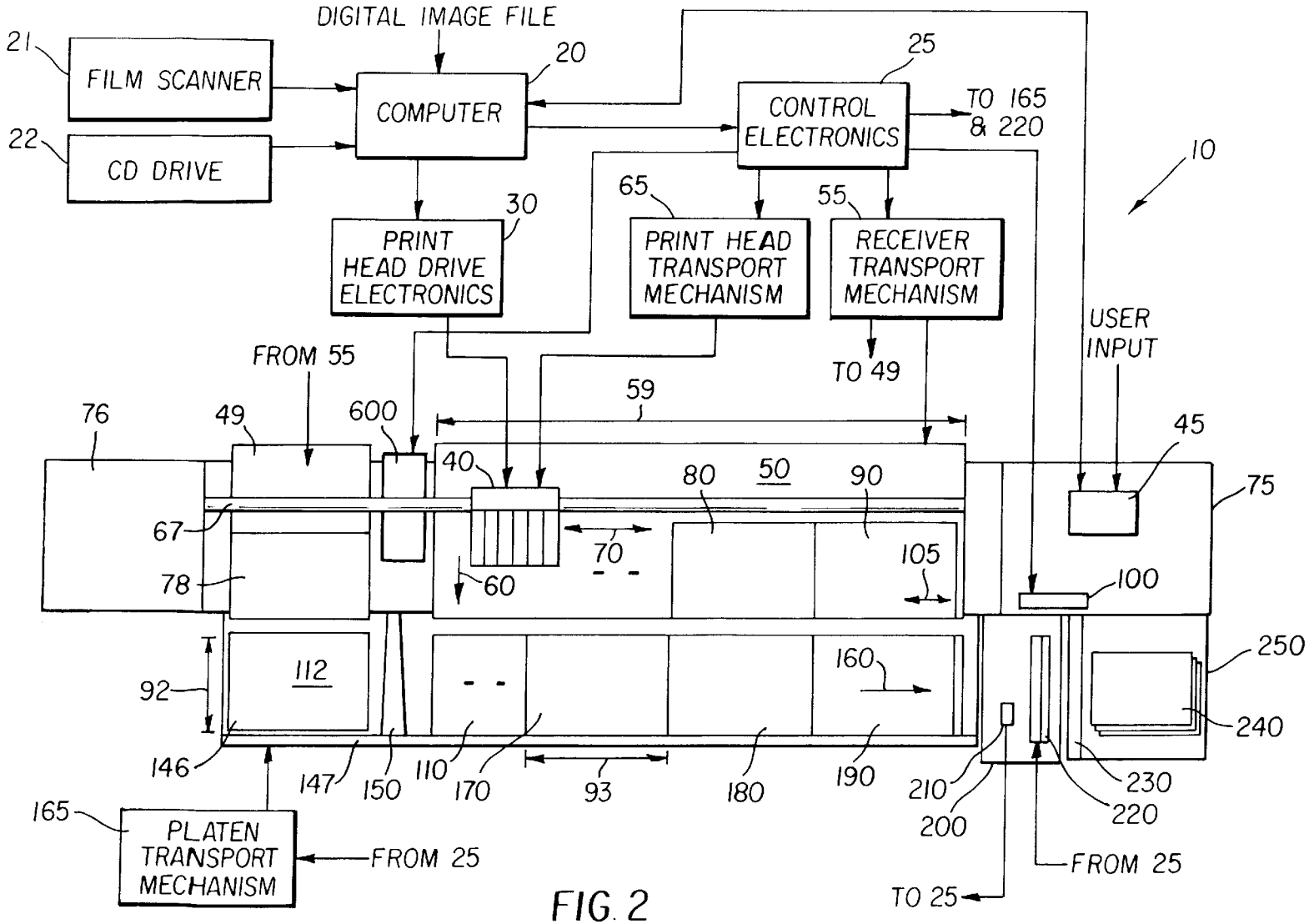
FIG. 2 is a partial top view of the ink jet printing apparatus of FIG. 1.

A partial perspective and a partial top view of an ink jet printing apparatus 10 in accordance with the present invention are shown in FIG. 1 and FIG. 2. For clarity, only the essential components in the ink jet printing apparatus are shown for illustrating the invention.

Referring to FIGS. 1 and 2, an ink jet printing apparatus 10 comprises a computer 20, a film scanner 21, a compact disk (CD) drive 22, control electronics 25, print head drive electronics 30, a plurality of ink jet print heads 40, a display panel 45, receiver transport mechanism 55, and print head transport mechanism 65. The display panel 45 has a touch-sensitive screen that can display information or receive input from a user or an operator. The ink jet printing apparatus 10 also includes a right frame housing 75 and a left frame housing 76.

The computer 20 receives a digital image file from a film scanner by scanning a photographic film (e.g. 35 mm, Advanced Photo System, slide film, etc.), or from a CD such as Picture CD, Photo CD, CD-ROM or DVD through the CD Drive 22. The digital image can also be transferred from a digital network or from a digital camera. Information about the digital images and printing modes of these images can be received from the display panel 45.

The digital image file in the computer 20 can include a plurality of digital images. Each digital image can include several color planes such as yellow, magenta, cyan, and black. The digital image file includes the desired image format to be printed on a narrow ink receiver 49 and a wide ink receiver 50, for each digital image. The image format includes the formats well known in the art such as 3"×5" (3R), 4"×6" (4R), high definition TV (HDTV), or panorama. The digital image file includes the number and the preferred sequence of the ink images to be printed. For example, a digital image file can be obtained by scanning a roll of 24 exposure 35 mm photographic film using the film scanner 21. A double prints and an index print can be requested by the customer. In this example, there are 49 ink images to be printed. The preferred sequence is often preferably the chronicle sequence when the photographs were taken. The digital image file can also include information such as the time, the location, the scene, exposure conditions, annotations etc. related to each digital image. The digital image file can also include large format digital images such as 11"×17", 3'×4', 4'×5', and other poster sizes. The width of the ink image can span substantially the full width of the narrow ink receiver 49 or the wide ink receiver 50. The ratio of the length to the width of the print having an ink image is referred as the aspect ratio. A user or an operator can input information such as above to be included in the digital image file using the display panel 45. The user can also input information about the annotation that he or she wants to appear on the ink images.

After receiving the digital image file(s), the computer 20 performs image processing on each individual digital image. As it is well known in the art, the image processing can include re-sizing, tone scale and color calibration, halftoning, swath cutting, and so on. Annotation information will be composed into the digital images as well. In the present invention, a plurality of digital images often need to be composed into a large digital image file. In this way, the ink jet print heads 40 can print a portion from each of several different ink images as the ink jet print heads 40 scan along print head scanning direction 70 in one printing pass.

As described below, the computer 20 analyzes the total number of ink images to be printed for each print job and maximizes the packing efficiency of the ink images on both the narrow ink receiver 49 and the wide ink receiver 50 such that receiver waste is reduced. Those skilled in the art will appreciate, although a plurality of ink jet print heads are preferred, a single ink jet print head that prints one or several color inks can also be used, especially if it is aligned across the print width 92. A print job is typically requested by one customer and can contain one or more digital image files.

The receiver transport mechanism 55 in the ink jet printing apparatus 10 can move the narrow ink receiver 49 and the wide ink receiver 50 along a first receiver path 60. The term receiver path means that the receivers 49 and 50 can be moved to a position where ink images 80 and 90 can be formed by the ink jet print heads 40. The narrow ink receiver 49 and the wide ink receiver 50 are provided, in the form of a web, by a narrow receiver roll 56 and a wide receiver roll 57 that are wound around a shaft 58. Receiver sensors (not shown) are provided in positions adjacent to the first receiver path 60 for detecting the lead edges of the narrow ink receiver 49 and the wide ink receiver 50. Such sensors send signals to the control electronics 25 defining the positions of the lead edges. The receiver transport mechanism 55 is controlled by the control electronics 25. As shown in FIG. 1, the narrow receiver roll 56 and the wide receiver roll 57 can be easily loaded and off-loaded for receiver change-over for loading new receiver rolls or receiver rolls of different widths. However, the presence of the narrow and wide receiver rolls can satisfy most of the printing needs at different formats. The frequency for receiver change-over is reduced and the printing throughput is therefore increased. For example, the width of the wide receiver roll 57 can range from 17", 20", 36" to 42"; the width of the narrow receiver roll 56 can range from 3.5", 4", 8", 10". A user or operator of the ink jet printing apparatus 10 can provide a user input to the display panel 45 representing the receiver width 59 of the wide ink receiver 50 on the wide receiver roll 57 as well as similar information on the narrow receiver roll 56. The computer 20, in response to this receiver width 59, composes digital images and operates the position of the ink jet print heads 40 to form ink images 80 and 90. These images 80 and 90 are properly positioned on the narrow ink receiver 49 and the wide ink receiver 50 to minimize receiver waste.

Figure 3:
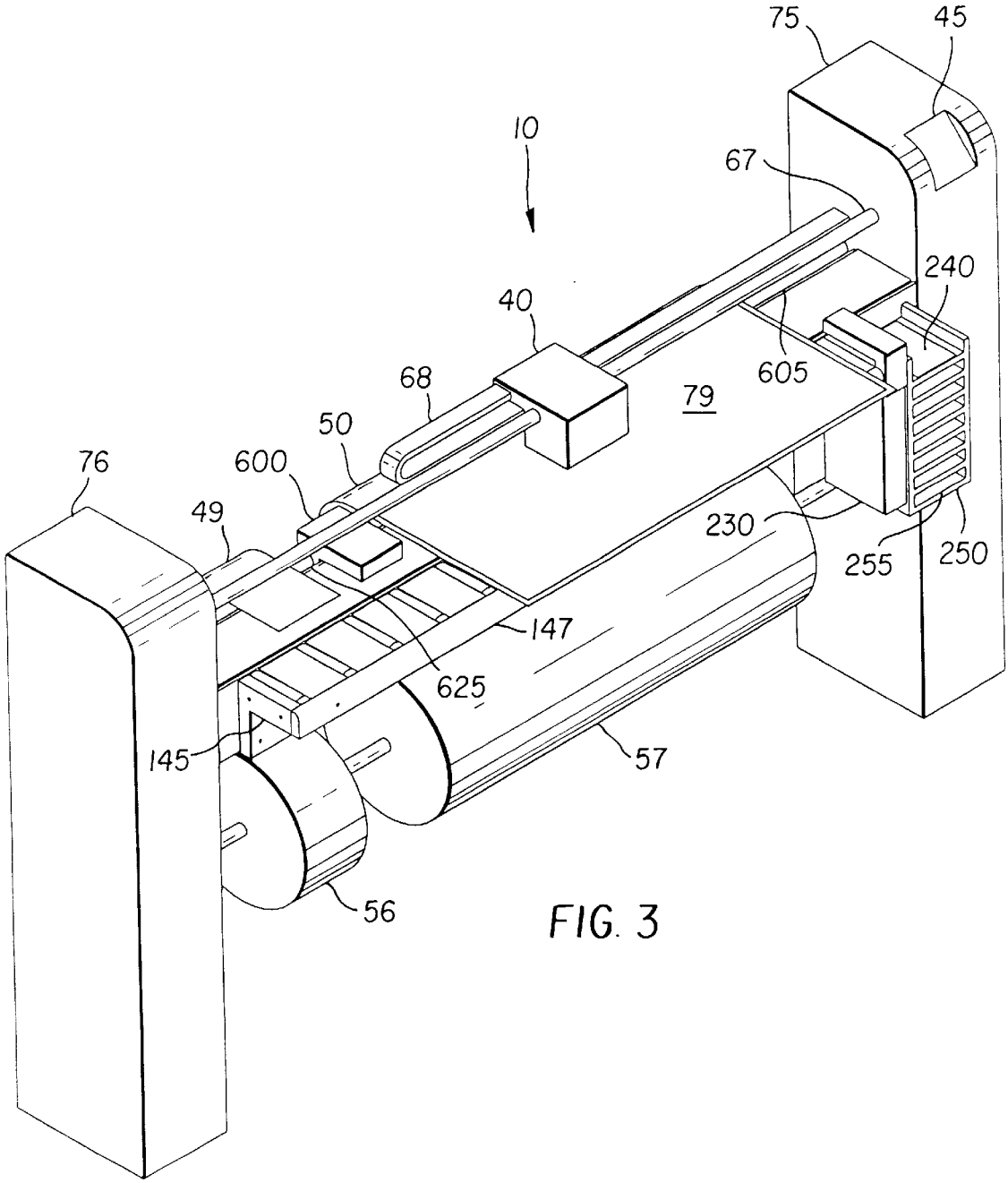
FIG. 3 shows a receiver transport configuration for printing ink images on a wide receiver web.
Figure 4:
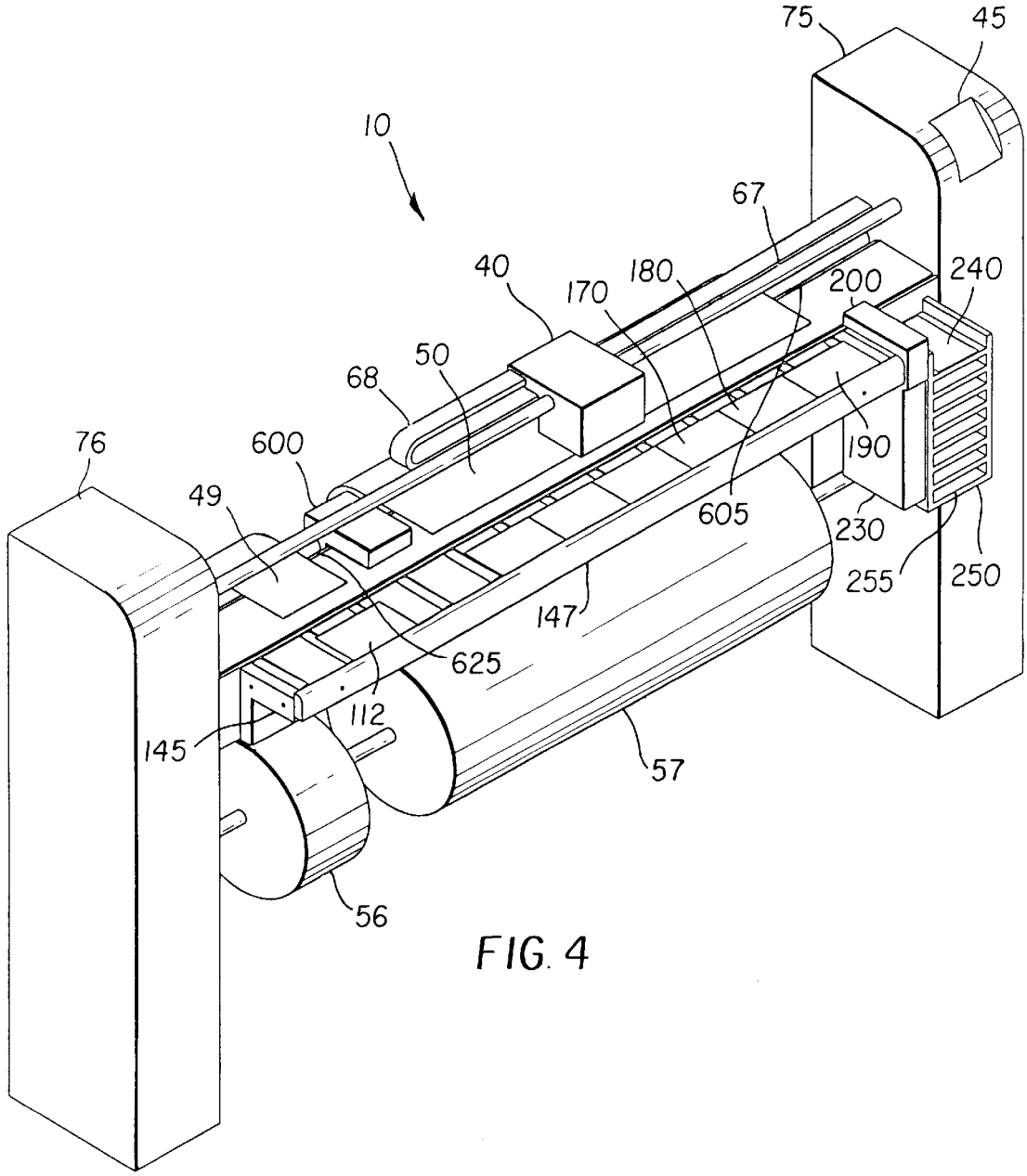
FIG. 4 shows a receiver transport configuration for simultaneously printing ink images on a narrow and a wide receiver webs.
Figure 5:
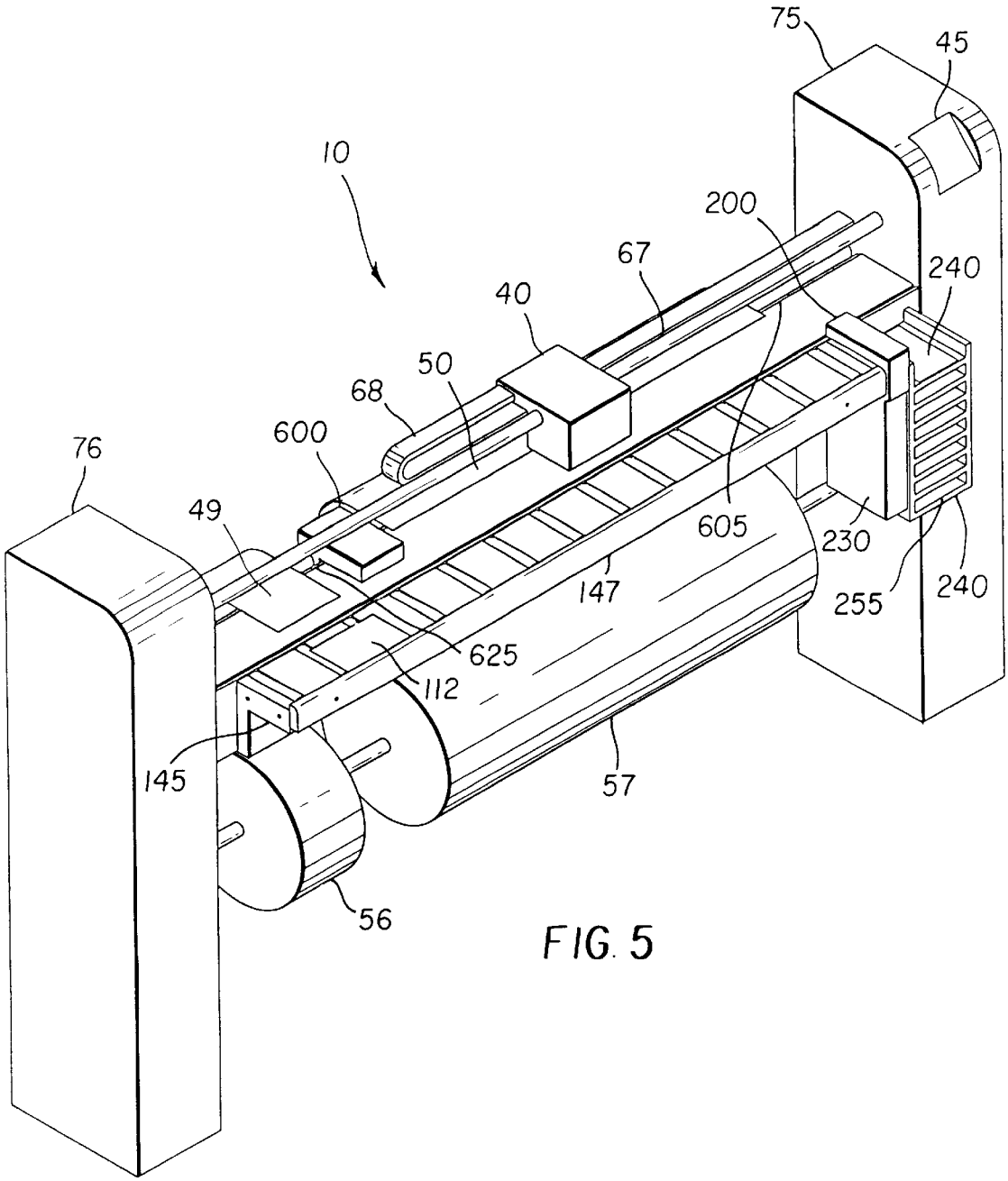
FIG. 5 shows a receiver transport configuration for printing ink images on a narrow receiver web.

As shown in FIGS. 3, 4 and 5, the narrow ink receiver 49 and the wide ink receiver 50 can be moved simultaneously or separately, depending on the specifics of the applications, by the receiver transport mechanism 55. In particular, the narrow ink receiver 49 and the wide ink receiver 50 are respectively driven by capstan rollers (not shown) through capstan rollers 605 and 625 and pinch rollers (not shown). The transport of the narrow ink receiver 49 and the wide ink receiver 50 is actuated by the transmission system 600 under the control of the control electronics 25. Details of the operation of the transmission system 600 are shown in FIGS. 6–8.

Figure 6:
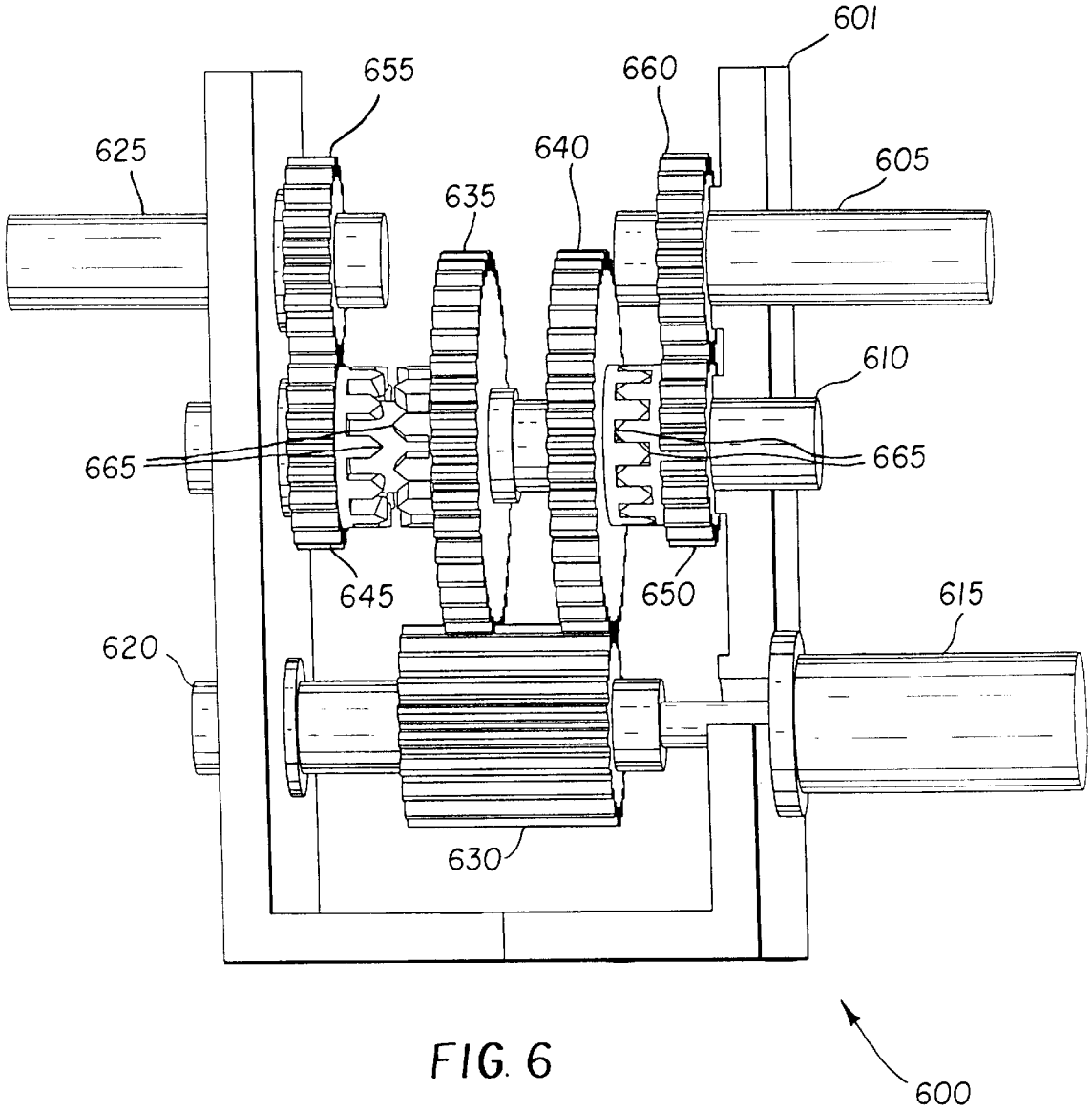
FIG. 6 shows the configuration of the transmission system for printing ink images on a wide receiver web.

FIG. 6 shows the transmission system 600 that drives either or both capstan rollers 605 and 625. The transmission system 600 as will be described has a plurality of selectively engagable gears for moving one or more receiver webs separately or simultaneously. A motor 615 is mounted to the transmission housing 601. A motor shaft 620 is mounted to a transmission housing 601 and keyed to the motor 615. A driving gear 630 that is mounted on the motor shaft 620 can be driven by the motor 615, in either clockwise or counterclockwise directions. An idler shaft 610 is also mounted to the transmission housing 601. Gears 635, 640, 645, and 650 are mounted to idler shaft 610. Gears 635 and 640 are in constant mesh with gear 630 and can rotate about the shaft 610. The gears 635 and 640 are adapted to be slid transversely along shaft 610 under the control of a solenoid and a shift lever (not shown) under the control of the control electronics 25. Gears 645 and 650 are transversely retained on shaft 610 but are also free to rotate on shaft 610.

In FIG. 6, teeth 665 of gears 635 and 645 are disengaged whereas the teeth 665 of gears 640 and 650 are engaged. When the motor 615 drives the gear 630, the gear 645 remains stationary while gear 650 rotates. The gear 650 drives the output gear 660 which further drives the capstan roller 605 for moving the wide ink receiver 50.

Figure 7:
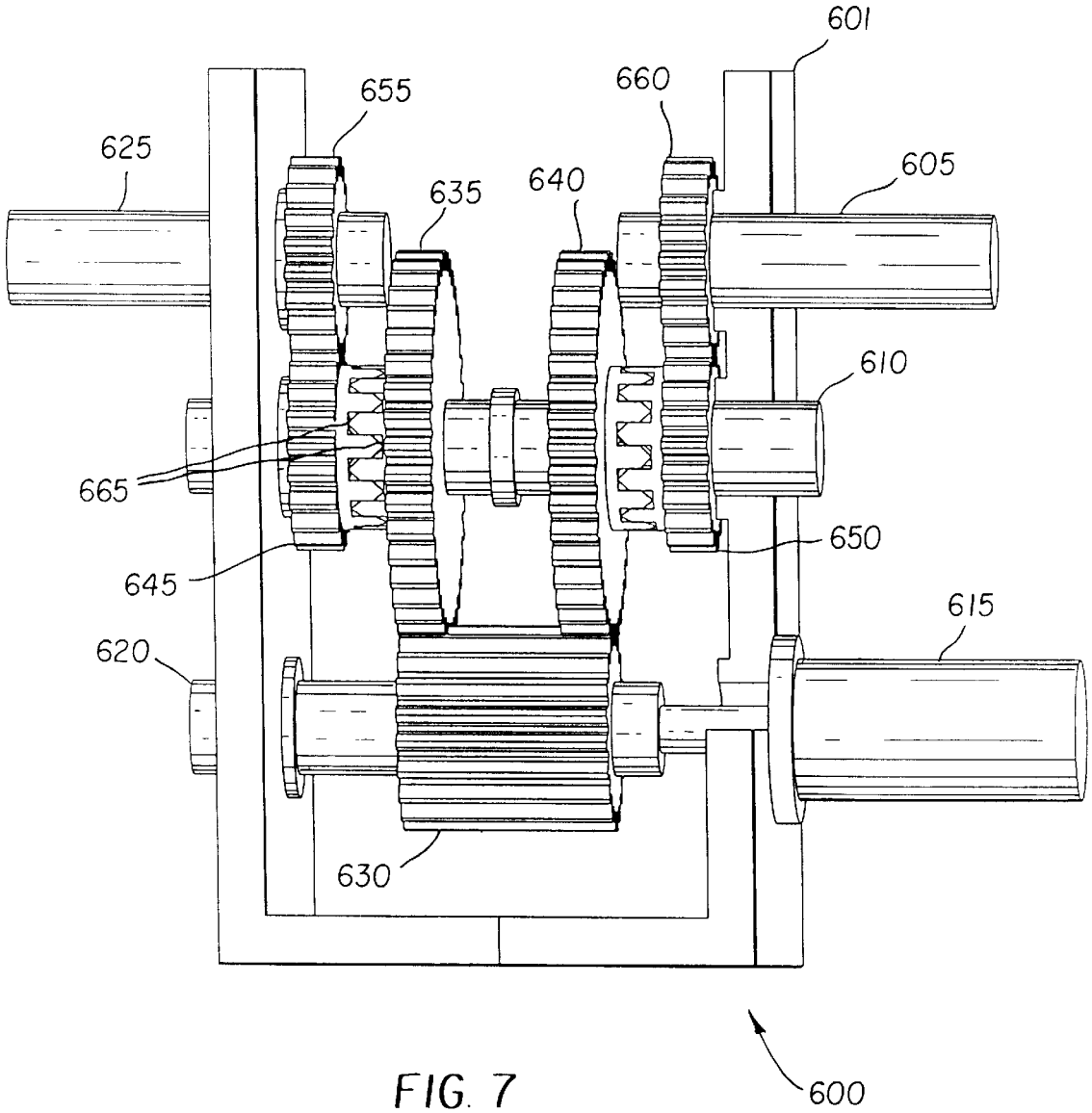
FIG. 7 shows the configuration of the transmission system for simultaneously printing ink images on a narrow and a wide receiver webs.
Figure 8:
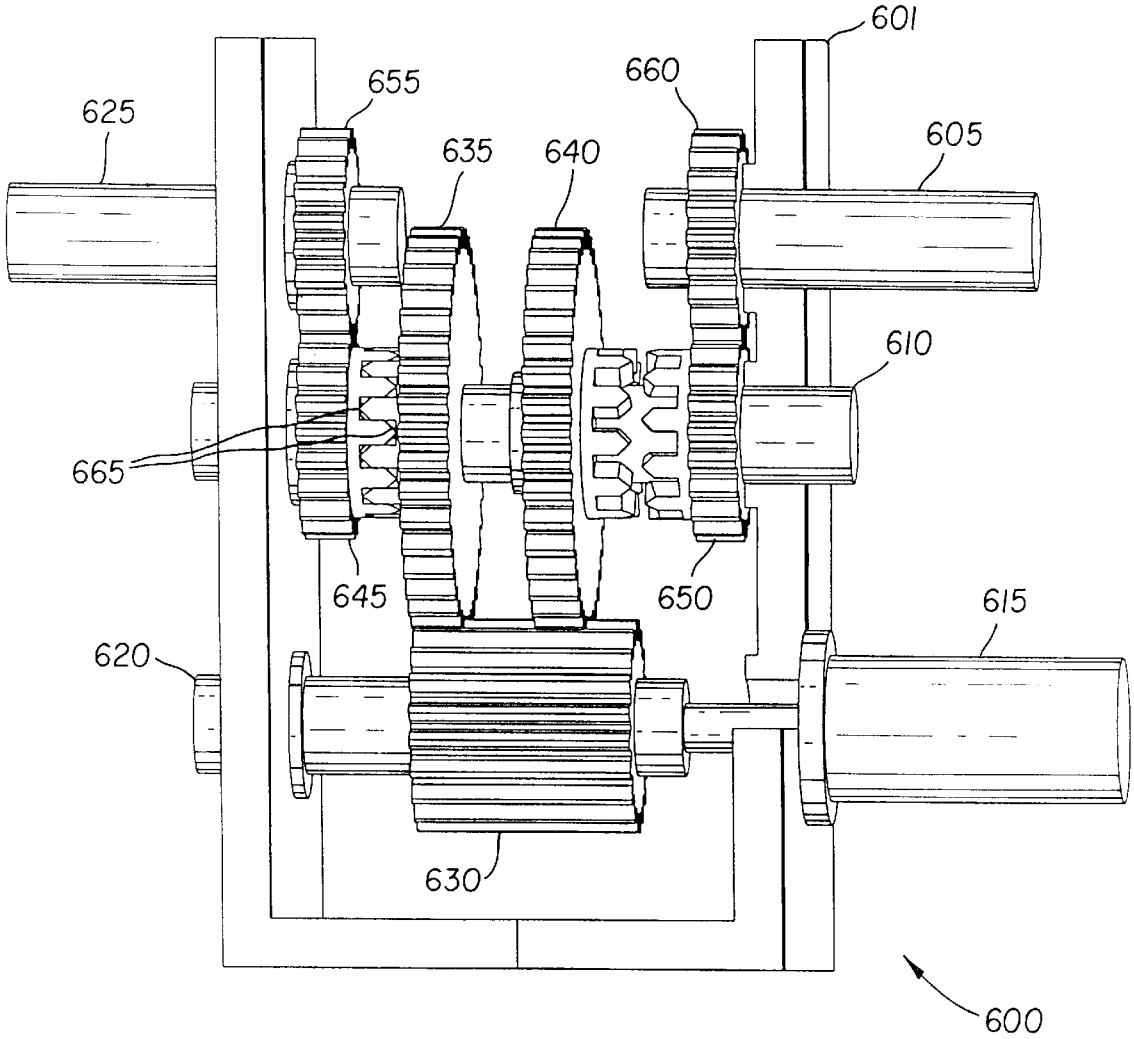
FIG. 8 shows the configuration of the transmission system for printing ink images on a narrow receiver web.

FIG. 7 shows the transmission system 600 wherein the gear 635 has been moved transversely by the solenoid (not shown) so that the teeth 665 of the gears 635 and 645 and the gears 640 and 650 are both engaged. Two pairs of gears are now rotated at the same angular velocity under the control of the control electronics 25. The gear 645 drives the output gear 655 which is keyed to the capstan roller 625 for moving the narrow ink receiver 49. Simultaneously, the gear 650 drives the output gear 660 which further drives the capstan roller 605 for moving the wide ink receiver 50.

FIG. 8 shows the transmission system 600 except now gear 635 has been moved transversely by the solenoid and the shift lever (not shown) so that the teeth 665 of the gears 635 and 645 are engaged and the teeth 665 of the gears 640 and 650 are disengaged. The gears 635 and 645 now rotate with the same angular velocity. The gear 645 drives the output gear 655 which is keyed to the capstan roller 625. Only the narrow ink receiver 49 is transported.

The ink jet printing apparatus 10 also includes ink reservoirs (not shown) for providing colored inks to the ink jet print heads 40. The ink jet printing apparatus 10 can also include print heads and ink reservoirs for printing and storing other color inks such as black, green, red, orange, gold, as well as inks of the same color but of different concentrations such as light cyan and light magenta inks.

The computer 20 can contain one or more digital image files each including at least one digital image. The computer 20 controls the print head drive electronics 30 according to the digital image file(s) to actuate and thereby cause the ink jet print heads 40 to print color images on the narrow ink receiver 49 and the wide ink receiver 50. During printing, the print head drive electronics 30 produces signals corresponding to image data from one or more than one digital image files. Each digital image file can include a plurality of digital images. A plurality of ink images (such as duplicates) can also be printed corresponding to each digital image, as defined in the digital image file or by user input to the computer 20 via display panel 45.

The ink jet print heads 40 can be a unitary structure or each print head can be separate for printing colored inks. Each ink jet print head 40 includes a plurality of ink nozzles and associated ink drop activators for delivering different color ink drops to the narrow ink receiver 49 and the wide ink receiver 50. The ink jet print heads 40 can be narrow print heads that print across the narrow ink receiver 49 and the wide ink receiver 50 in a raster or swath fashion. The ink drop ejection can be actuated from the ink nozzles by the ink jet activation means well known in the art, for example, piezoelectric actuators or thermal electric actuators. The ink jet print heads 40 are transported by the print head transport mechanism 65 along the guiding rail 67 under the control of the control electronics 25. The ink jet print head 40 is connected with a flexible connector 68. The flexible connector 68 houses the electric data cables from the print head drive electronics 30 to the ink jet print heads 40 and the ink lines that supply color inks to the ink jet print heads 40. The ink jet print heads 40 scans and prints in print head scanning direction 70 across the first receiver path 60 in one printing pass. The narrow ink receiver 49 and the wide ink receiver 50 are moved along the first receiver path 60. The next pass is subsequently printed. The ink jet print heads 40 can print either in one direction or bidirectionally. In operation, they are moved across the receiver in each pass. In a bidirectional mode, they are not returned to a home position, but are traversed in a direction opposite to the first pass.

In accordance with the present invention, still referring to FIGS. 1 and 2, the ink jet printing apparatus 10 also includes a first receiver cutter 100 and a second receiver cutter 220. The first receiver cutter 100 and the second receiver cutter 220 are actuatable by the control electronics 25. The first receiver cutter 100 is preferably a cutting wheel, which is commonly in large-format ink jet printers. The second receiver cutter 220 preferably has two spaced apart and parallel blades so that in operation it will cut off the border in between two sequential images at each cut. Those skilled in the art will appreciate that the arrangement can be made so that the distance between blades is adjustable. The first receiver cutter 100 is movable across the narrow ink receiver 49 and the wide ink receiver 50 along the first cutting direction 105 under the control of control electronics 25. The control electronics 25 can vary the width of the prints and the length of the prints can also be varied by operating the cutters 100 and 220.

A receiver transport shelf 145 is provided at the exit end of the first receiver path 60 for sorting the large and small format prints. On the receiver transport surface 146 of the receiver transport shelf 145, there is provided a plurality of rotatable cone-shaped rollers 150. A receiver registration plate 147 is positioned against the outside edge of the receiver transport surface 146. The receiver registration plate 147 is moved up and down by a platen transport mechanism 165. The cone-shaped rollers 150 are oriented such that the ends of larger-diameter are pointed toward the receiver registration plate 147. When actuated, as described below, these cone-shaped rollers 150 can transport an ink image set 110 along the second receiver path 160 while aligning the ink image set along the receiver registration plate 147.

The receiver registration plate 147 is disposed adjacent to the receiver transport shelf 145 and movable by the receiver platen mechanism 165 between a first blocking position (shown in FIGS. 4 and 5) for printing small-format images to a second unblocking position (shown in FIG. 3) for printing large-format images. The cone-shaped rollers 150 are rotated by a motor (not shown) which is under the control of platen transport mechanism 165. After the narrow ink receiver 49 and the wide ink receiver 50 are cut by the first receiver cutter 100, the receivers having the ink image 112 and the ink image set 110 drop onto the receiver transport surface 146 (shown in FIG. 4). The platen transport mechanism 165 causes the cone-shaped rollers 150 to register the receiver against the receiver registration plate 147 and advance the receiver to the second receiver cutter 220 where the prints 240 are cut to desired sizes. The prints 240 are then placed into print tray compartments 255 of the print tray 250.

FIGS. 3 and 6 show the receiver transport configuration when a large format ink image 79 is in the process of being printed. When a large format ink image 79 of full receiver width 59 is to be printed as defined by a digital image file and the user input, the receiver registration plate 147 is moved down by a platen transport mechanism 165. The wide ink receiver 50 carrying the large format ink image 79 is transported passing the receiver transport shelf 145. The wide ink receiver 50 large format ink image 79 can then be wound to a roller (not shown) or dropped to a large receiver tray similar to the commercial large format ink jet printers. It should be noted that the ink jet printing apparatus 10 can print a single digital image on the wide ink receiver 50 as a large format ink image as described above.

FIGS. 2, 4 and 7 show the receiver transport configuration when a plurality of small-format ink mages are in the process of being printed. The narrow receiver roll 56 and the wide receiver roll 57 are first transported simultaneously to printing positions by the receiver transport mechanism 55 under the control of the control electronics 25. The configuration of the transmission system 600 is shown in FIG. 7.

Ink images 78, 80 and 90 corresponding to these digital images can be conveniently defined to be the same as the formats corresponding to silver halide photographs such as 3.5"×5" (3R), 4"×6" (4R), high definition TV (HDTV) (4"×7"), or panorama (4×11.5"). In the present invention, the two dimensions of the ink images 78, 80 and 90 are referred as the print width 92 and the print length 93 (as shown in FIG. 2). Preferably, the ink images 78, 80 and 90 that are distributed across the first receiver path 60 will have the same print width 92. The ink images 78, 80 and 90 are distributed on the narrow ink receiver 49 and the wide ink receiver 50 to minimize the unprinted area (946 in FIG. 9) to reduce waste. For ink images 80 and 90 of the same print width 92, the print length 93 can vary depending on the specific format of each ink image. For example, the print width 92 of the ink images 80 and 90 can be 4". The 4R, HDTV, and panoramic formats require the print lengths 93 to be 6", 7.5", 10", 11" and 12", respectively.

Still referring to FIGS. 2, 4 and 7, after the set of small-format ink images 78, 80 and 90 are printed across the first receiver path 60, the narrow ink receiver 49 and the wide ink receiver 50 are cut by the first receiver cutter 100 along the first cutting direction 105 to form ink image 112 and ink image set 110. The ink images 80 and 90 preferably have the same print width 92. Since borderless prints are often desired for simulating the traditional photograph, the image borders can be cut off along the side of the print lengths of the ink images 80 and 90. Although not shown, the image borders can be dropped to a slug container. The ink images 80 and 90 in an ink image set 110 can be separated by unprinted areas across the first receiver path 60. Furthermore, separation marks can also be printed by the ink jet print heads between the ink images 80 and 90. The separation masks can be encoded to carry the information about the length of the ink image following the separation mark along a second receiver path 160 which is perpendicular to the first receiver path 60.

When small format ink images 80 and 90 are printed, according to the digital image file and the user input, the receiver registration plate 147 is moved up by the platen transport mechanism 165. After the first receiver cutter 100 performs its cutting operation, the ink image set 110 is formed on the receiver. The ink image set 110 is shown to include a plurality of ink images 170, 180, 190. The ink image set 110 transferred onto receiver transport shelf 145. The upward positioned receiver registration plate 147 limits the movement of the ink image set 110 in the direction of the first receiver path 60. The cone-shaped rollers 150 are actuated by the platen transport mechanism 165 to move the ink image set 110 along the second receiver path 160. The platen transport mechanism 165 is under the control of the control electronics 25. As described above, the cone-shaped rollers 150 drive the ink image set 110 to be aligned to the receiver registration plate 147 during the movement along the second receiver path 160. If needed, the ink image set 110 can be moved back and forth relative to the second receiver path 160 to move the ink image set 110 to be in contact with the receiver registration plate 147. The ink image set 110 is transported by the cone-shaped rollers 150 to a receiver cutter device 200. The receiver cutter device 200 includes a receiver detector 210 and a second receiver cutter 220.

As the ink image set 110 is moved through the receiver cutter device 200, the receiver detector 210 detects the lead edge of the ink image set 110. The receiver detector 210 can also detect the unprinted area, separation arks, or borders between the ink images 170, 180, and 190. The receiver detector sends signals to control electronics 25 which sends a receiver position signal further to computer 20. The computer 20 calculates the border positions of the ink images 170, 180, 190 of the ink image set 110. The computer 20 then controls the control electronics 25 to actuate the second receiver cutter 220 to sequentially cut the ink image set 110 to remove portions of the receiver between the printed ink images 170–190 as waste and forms the prints 240. The waste or slug is dropped into a slug container 230. In this way, separate prints 240 having ink images of a desired size are formed in response to a digital image file. The prints 240 are placed and stacked in a print tray 250. The print tray 250 can include a plurality of print tray compartments 255, each of which can be used to store a group of prints 240. It is often desired to store the prints 240 from the same customer or prints of the same format size in the same print tray compartment 255.

In accordance with the present invention, as described above, an ink image set 110 comprising a plurality of ink images 170–190 are first formed before individual prints 240 are prepared and stacked. A delay time is therefore provided after the printing operation and the stacking operation. This delay time provides extra time for the ink images 80, 90, 170–190 to dry on the wide ink receiver 50, which is beneficial for minimizing image artifacts related to insufficient drying.

Another advantage in accordance with the present invention is in the long printing pass length that can span across both the narrow ink receiver 49 and the wide ink receiver 50. As it is well known in the art, a long printing pass increases the duty cycle of ink jet printing and thereby increasing the printing throughput.

FIGS. 5 and 8 show the receiver transport configuration when small-format ink mages are in the process of being printed on the narrow ink receiver 49. The narrow receiver roll 56 is first transported to a printing position by the receiver transport mechanism 55 under the control of the control electronics 25. The configuration of the transmission system 600 is shown in FIG. 8.

An ink image 49 is first printed by the ink jet print heads 40. The receiver registration plate 147 is moved up by the platen transport mechanism 165. After the first receiver cutter 100 performs its cutting operation, an ink image 112 is formed on the receiver. The ink image 112 is transferred onto receiver transport shelf 145. The upward positioned receiver registration plate 147 limits the movement of the ink image 112 in the direction of the first receiver path 60. The cone-shaped rollers 150 are actuated by the platen transport mechanism 165 to move the ink image 112 along the second receiver path 160. The cone-shaped rollers 150 drive the ink image 112 to be aligned to the receiver registration plate 147 during the movement along the second receiver path 160. The ink image 112 is transported by the cone-shaped rollers 150 to a receiver cutter device 200.

As the ink image 112 is moved through the receiver cutter device 200, the receiver detector 210 detects the lead edge of the ink image 112. The receiver detector sends signals to control electronics 25 which sends a receiver position signal further to computer 20. The computer 20 calculates the border positions of the ink image 112. If needed, the computer 20 then controls the control electronics 25 to actuate the second receiver cutter 220 to cut the borders of the ink image 112. The waste or slug is dropped into a slug container 230. In this way, separate prints 240 having ink images of a desired size are formed in response to a digital image file. The prints 240 are placed and stacked in a print tray 250.

Figure 9:
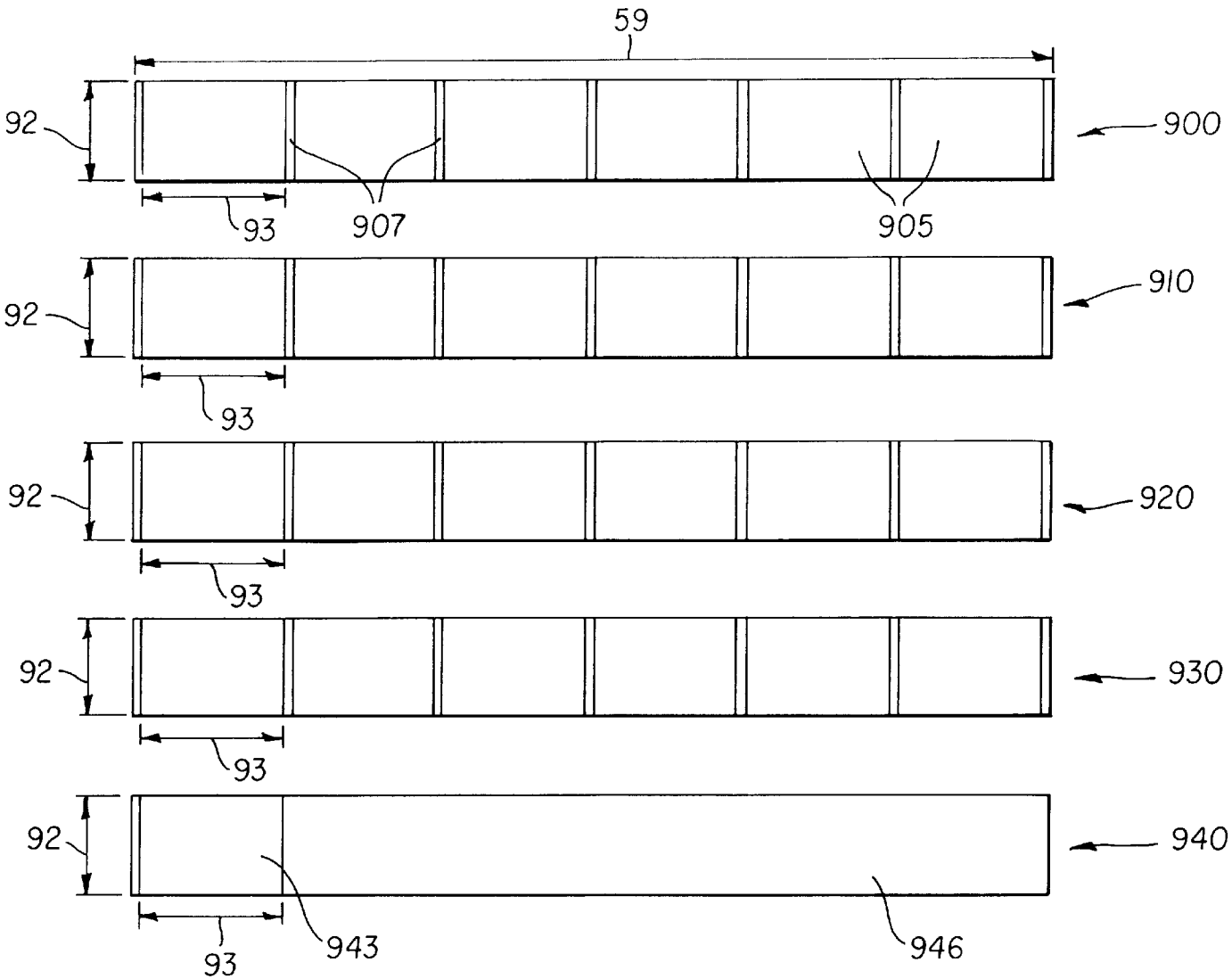
FIG. 9 shows a layout of ink images and the receiver waste when the ink images are formed only on the wide receiver web but not on the narrow receiver web.

One advantage of the present invention is the reduction of receiver waste by optimally distributing ink images on both the narrow and wide ink receivers. FIG. 9 illustrates such receiver waste when ink images are formed only on a wide ink receiver 50. For a specific example, the receiver width 59 can be 37" for the wide receiver web 50. A plurality of ink image sets 900, 910, 920, 930, and 940 can be formed on the wide receiver web. As described above, an image border may exist between two adjacent ink image sets and the image border can be cut off as slugs by the first receiver cutter 100. Each ink image set includes one or more ink images 905 and 943. The ink images are in 4R size, that is, the print length 93 is 6" and the print width 92 is 4". An eighth inch image border 907 can also be provided between the neighboring ink images 905 in each ink image set 900 through 940. The image borders 907 will be cut off by the second receiver cutter 220, also as described above. For the receiver width 59 of 37", there can be a maximum of 6 4" ink images distributed across the first receiver path 60.

In the exemplary configurations described above, there is a minimal amount of receiver waste (1" out 37" in an ink image set) when six 4R ink images 905 are printed in each ink set (900–930). In other words, receiver waste can be minimized when a print job requires the printing of a multiple of six ink images. Examples of these include 24 or 36 single or double 4R prints. Receiver waste is greatly increased, when a print job has a number of ink images not divisible by 6. For example, as shown in FIG. 9, a $25^{th}$ ink image needs to be formed on a fifth ink image set 940. This $25^{th}$ ink image can be an extra image the customer has shot on a 24-frame photographic film or an index print containing thumbnail images for a 24-frame photographic film. This situation results in a large unprinted receiver area 946, as shown clearly in FIG. 9. Principally, this unprinted receiver area 946 can be printed by the next print job. But in a microlab, the ink jet printing apparatus often receives one print job at one time. Receiver usage optimization is often not possible because a fast turn-around is often required for each customer. In summary, the unprinted receiver area 946 results in a large receiver waste.

Figure 10:
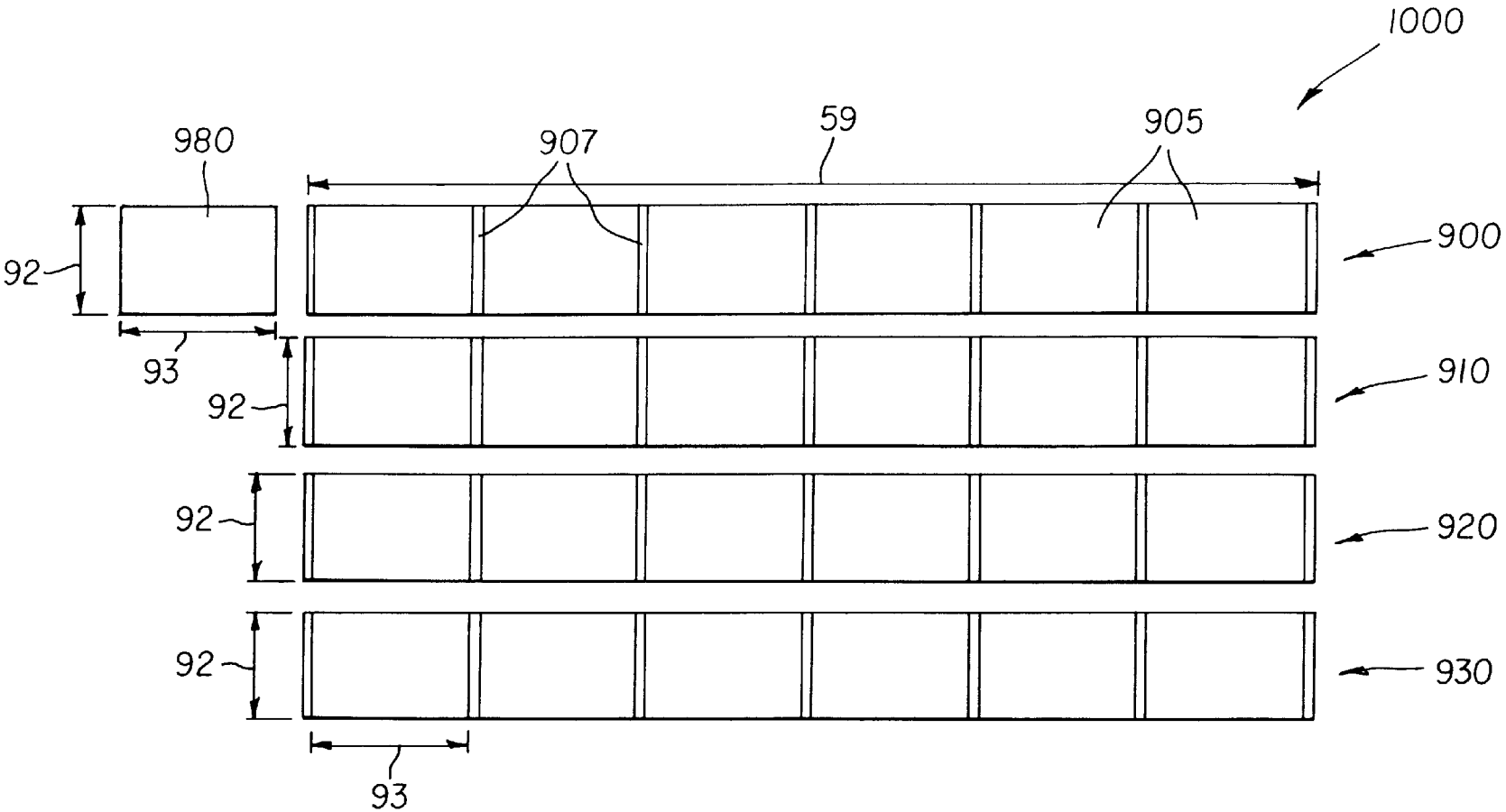
FIG. 10 shows a layout of ink images formed on the wide and the narrow receiver webs and how receiver waste is minimized.

FIG. 10 shows how receiver waste is minimized when ink images formed on the wide ink receiver 50 and the narrow ink receiver 49. In addition to the wide receiver roll 57, a narrow receiver roll 56 is provided. Still using the example described above, the narrow ink receiver 49 supplied from the narrow receiver roll 56 has a width of 6" or slightly wider that is suitable for containing one 4R (4"×6") ink image. With the narrow ink receiver, the extra ink images (ink image on the narrow receiver web 980) can now be printed on the narrow ink receiver. It is understood that the ink image on the narrow receiver web 980 can be chosen as one of the 25ink images to be printed so that when the ink images are transported along the second receiver path 160 and cut by the second receiver cutter 220, the prints 240 can be stacked in an order desired by the customers. The large amount of receiver waste in the unprinted receiver area 946 (in FIG. 9) by using the wide ink receiver alone is now eliminated.

Furthermore, the ink image on the narrow receiver web 980 and the ink images 905 in the first to fourth ink image sets 900–930 are formed in a plurality of digital image 1000 by the computer 20 so that the images can be printed in the same printing pass on both the narrow ink receiver 49 and the wide ink receiver 50 simultaneously. As it is well known in the art, longer printing passes are also beneficial for increasing printing throughput.

In FIGS. 9 and 10, 4R (4"×6") ink images and a particular receiver width are used to illustrate the receiver waste and how it can be minimized. It is understood, however, that the receiver waste generally exist for ink images in other formats such as 3.5"×5" (3R), high definition TV (HDTV) (4"×7"), panorama (4×11.5"), A size (8.8"×11"). Likewise, the minimization of receiver waste can also be generalized in accordance to the present invention. Furthermore, a print job can have more than one format size in one (or a batch of) digital image file(s). The receiver configuration can be tailored to optimize the receiver usage at each format. For example, a 3R print job can be printed with a 5" wide narrow receiver web and a wide receiver web. In addition, more than one narrow receiver webs can be provided in parallel to the wide ink receiver 50. For example, one narrow receiver web for 3R format ink images and another for 4R format ink images.

Figure 11:
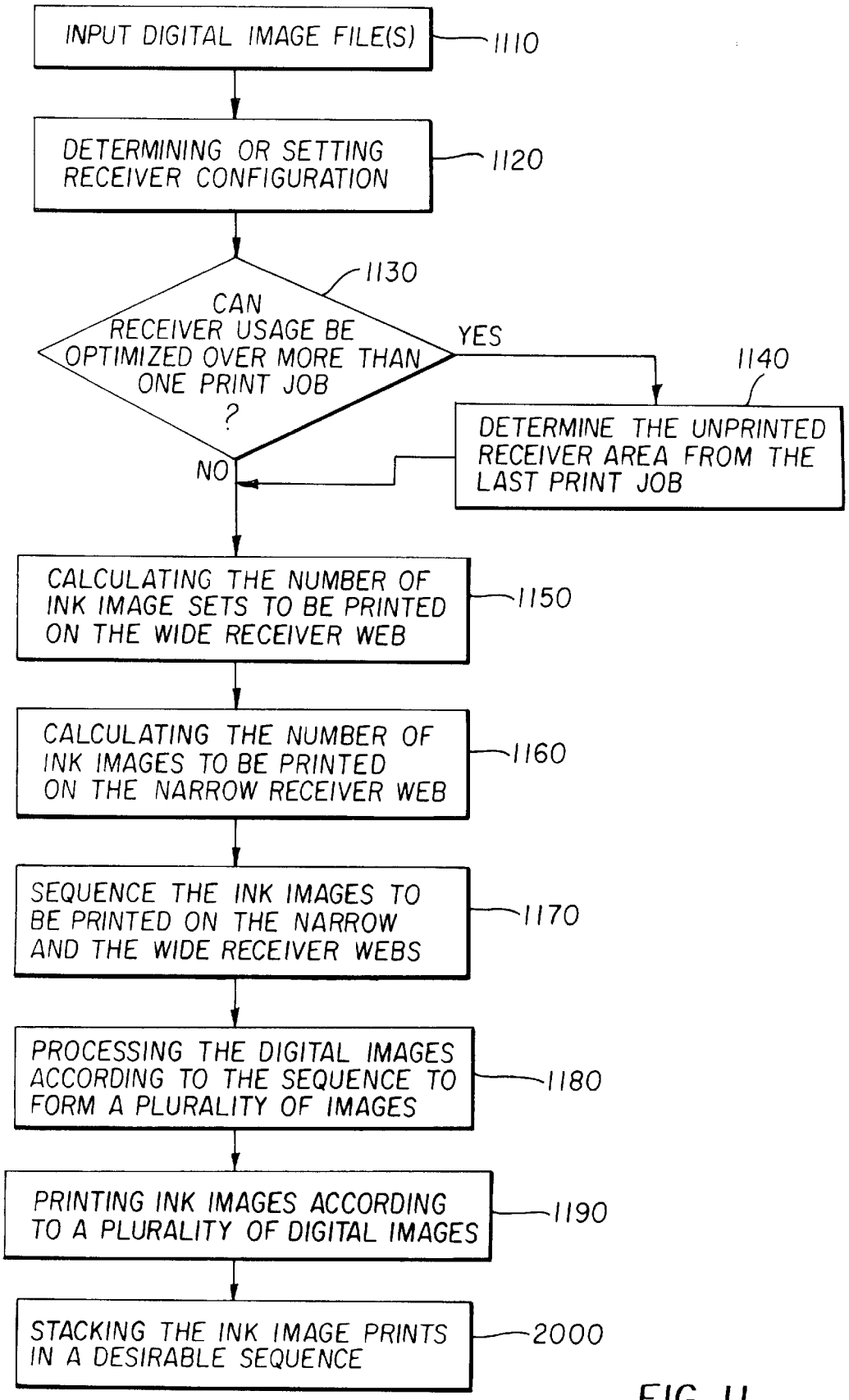
FIG. 11 shows a flow chart of the operational steps for minimizing receiver waste in the ink jet printing apparatus in accordance with the present invention.

FIG. 11 shows a flow chart of the operational steps for minimizing receiver waste in the ink jet printing apparatus in accordance with the present invention. In box 1110, the digital image file(s) are input to the computer 20. Next, in box 1120, the computer 20 determines the receiver configuration such as the number of receiver webs loaded on the ink jet printing apparatus 10 and the width of each ink receiver. In some cases, a receiver web of different width may be loaded for the optimal receiver usage or other customer needs. As described above, more than one narrow ink receiver 49 may be available.

In box 1130, a question is asked whether the receiver usage can be optimized over more than one print job? The answer is yes when more than one print jobs are requested at this time and when there is unprinted receiver area 946 in the last print job. The unprinted receiver area from the last print job is determined in box 1140. Following box 1140 or if the answer to the question in box 1130 is NO, the number of ink image sets to be printed on the wide receiver web is calculated in box 1150. These ink image sets will occupy the wide ink receiver in an efficient fashion, for example, the ink image sets 900, 910, 920 and 930 in FIG. 10. As discussed above, ink images of different print lengths can be included in the ink image sets. Next, in box 1160, the computer 20 calculates the number of ink images (e.g. the ink image on the narrow receiver web 980 in FIG. 10) to be printed on the narrow receiver web. In box 1170, the computer 20 sequences all ink images to be printed on the narrow and the wide receiver webs in that print job. The desirable sequence of the ink images can be made according to the definitions in the digital image file. In box 1180, the computer processes the digital images corresponding to these ink images according to the sequence to form a plurality of images 1000. As described above, proper image borders are designed between ink images within an ink image set as well as between ink image sets.

In box 1190, the ink images in the print job are printed by the ink jet print heads 40 under the control of the print head drive electronics 30 according to a plurality of digital images sent from the computer 20. Finally, in box 2000, the prints carrying these printed ink images are stacked in the desirable sequence in print tray compartments 255.

The invention has been described in detail with particular reference to certain preferred embodiments thereof, but it will be understood that variations and modifications can be effected within the spirit and scope of the invention.

Parts List

10 ink jet printing apparatus
20 computer
21 film scanner
22 CD drive
25 control electronics
30 print head drive electronics
40 ink jet print heads
45 display panel
49 narrow ink receiver
50 wide ink receiver
55 receiver transport mechanism
56 narrow receiver roll
57 wide receiver roll
58 shaft
59 receiver width
60 first receiver path
65 print head transport mechanism
67 guiding rail
68 flexible connector
70 print head scanning direction
75 right frame housing
76 left frame housing
78 ink image
79 large format ink image
80 ink image
90 ink image
92 print width
93 print length Parts List (con't)

100 first receiver cutter
105 first cutting direction
110 ink image set
112 ink image
145 receiver transport shelf
146 receiver transport surface
147 receiver registration plate
150 cone-shaped roller
160 second receiver path
165 platen transport mechanism
170 ink image
180 ink image
190 ink image
200 receiver cutter device
210 receiver detector
220 second receiver cutter
230 slug container
240 print
250 print tray
255 print tray compartment
600 transmission system
601 transmission housing
605 capstan roller
610 idler shaft
615 motor
620 motor shaft
625 capstan roller
630 driving gear
635 gear Parts List (con't)

640 gear
645 gear
650 gear
655 output gear
660 output gear
665 teeth
900 first ink image set
905 ink images
907 image border
910 second ink image set

920 third ink image set
930 fourth ink image set
940 fifth ink image set
943 mismatched ink image
946 unprinted receiver area
980 ink image on the narrow receiver web
1000 a plurality of digital images
1110 Input digital image file(s)
1120 Determining or setting receiver configuration
1130 Can receiver usage be optimized over more than one print job?
1140 Determine the unprinted receiver area from the last print job
1150 Calculating the number of ink image sets to be printed on the wide receiver web
1160 Calculating the number of ink images to be printed on the narrow receiver web
1170 Sequence the ink images to be printed on the narrow and the wide receiver webs
1180 Processing the digital images according to the sequence to form a plurality of images Parts List (con't)

1190 Printing ink images according to a plurality of digital images
2000 Stacking the ink image prints in a desirable sequence

What is claimed is:

1. Ink jet printing apparatus for forming a plurality of ink images on receivers in response to one or more digital image file(s) each including at least one or more digital image and information indicating the sequence and the number of ink images to be made, comprising:

a) at least one ink jet print head adapted to deliver ink to the receiver;

b) means for providing at least two receiver webs, one being wider than the other;

c) moving means for selectively moving one or more receiver webs alone a receiver path past the ink jet print head;

d) control means responsive to the digital image file(s) for determining the locations of the ink images to be formed on the two receiver webs in such a manner that minimizes receiver waste by calculating the sequence and the number of ink images to be made on the wide receiver web and the number of ink images to be formed on the narrow web and organizing the sequence of such images; and e) means coupled to the control means for actuating the ink jet print head to form ink images on the receiver webs, whereby receiver waste is minimized.

2. Ink jet printing apparatus for forming a plurality of ink images on receivers in response to one or more digital image file(s) each including at least one or more digital image and information indicating the sequence and the number of ink images to be made and for cutting the receivers to form separate prints of such ink images, comprising:

a) at least one ink jet print head adapted to deliver ink to the receiver;

b) means for providing at least two receiver webs, one being wider than the other;

c) first moving means for selectively moving the web(s) along a receiver path past the ink jet print head;

d) control means responsive to the digital image file(s) for determining the locations of the ink images to be formed on the two receiver webs in such a manner that minimizes receiver waste by calculating the sequence and the number of ink images to be made on the wide receiver web and the number of ink images to be formed on the narrow web and organizing the sequence of such images;

e) first actuatable receiver cutting means responsive to the control means for cutting the receiver across the first receiver path;

f) second moving means for moving the cut receiver along a second receiver path that is perpendicular to the first receiver path;

g) second actuatable cutting means responsive to the control means disposed at a predetermined position relative to the second receiver path for sequentially cutting the receiver to form separate prints each having at least one ink image; and h) the control means further including means for actuating the first and second moving means and the first and second actuatable cutting means in a time sequence so as to automatically produce prints of images.

3. The ink jet printing apparatus of claim 2 wherein the web moving means includes means for controlling the movement of one or more of the receiver webs such that ink images can be printed by the ink jet print heads on one or more receiver webs separately or simultaneously.

4. The ink jet printing apparatus of claim 2 wherein the properly sequenced digital images are printed to form ink images and the prints of images are formed by cutting operation of the second receiver cutter and the prints are stacked in the proper sequence as defined in the digital image file(s).

* * * * *